US005178644A

United States Patent [19]

Huzinec

[11] Patent Number: 5,178,644

[45] Date of Patent: Jan. 12, 1993

[54] METHOD FOR MAKING VITREOUS BONDED ABRASIVE ARTICLE AND ARTICLE MADE BY THE METHOD

[75] Inventor: Gary Huzinec, Cincinnati, Ohio

[73] Assignee: Cincinnati Milacron Inc., Cincinnati, Ohio

[21] Appl. No.: 824,644

[22] Filed: Jan. 23, 1992

[51] Int. Cl.[5] ..... B24D 3/00

[52] U.S. Cl. ..... 51/293; 51/298; 51/308; 51/309

[58] Field of Search ..... 51/293, 298, 308, 309

[56] References Cited

U.S. PATENT DOCUMENTS

| | | | |
|---|---|---|---|
| 3,664,819 | 5/1972 | Sioui et al. | 51/295 |
| 3,779,727 | 12/1973 | Siqui et al. | 51/298 |
| 3,868,232 | 2/1975 | Sioui et al. | 51/298 |
| 3,881,890 | 5/1975 | Birle | 51/298 |
| 3,916,584 | 11/1975 | Howard et al. | 51/309 |
| 3,925,035 | 12/1975 | Keat | 51/309 |
| 4,042,346 | 8/1977 | Sioui et al. | 51/298 |
| 4,042,347 | 8/1977 | Sioui | 51/298 |
| 4,157,897 | 6/1979 | Keat | 51/295 |
| 4,184,854 | 1/1980 | Sioui et al. | 51/298 |
| 4,305,898 | 12/1981 | Obersby | 51/298 |
| 4,308,035 | 12/1981 | Danilova et al. | 51/298 |
| 4,334,895 | 6/1982 | Keat | 51/309 |
| 4,378,233 | 3/1983 | Carver | 51/298 |
| 4,907,376 | 3/1990 | Bouchard et al. | 51/209 |
| 4,923,490 | 5/1990 | Johnson et al. | 51/298 |
| 4,951,427 | 8/1990 | St. Pierre | 51/293 |
| 4,997,461 | 3/1991 | Markhoff-Matheny et al. | 51/295 |

*Primary Examiner*—William R. Dixon, Jr.
*Assistant Examiner*—Willie J. Thompson
*Attorney, Agent, or Firm*—John W. Gregg; Donald Dunn

[57] ABSTRACT

A method for making vitreous bonded grinding wheels having a porosity of from 20 to 55% by volume is provided that reduces or prevent shrinkage. The method includes a step of mixing unclad, non-abrasive, non-metallic, particulate, inorganic solid shrinkage control agent with the abrasive grain, vitreous matrix precursor and other ingredients for producing the wheel. Non-abrasive hexagonal boron nitride is a preferred shrinkage control agent and may be used in amounts ranging for 1 to 10% by volume based on the volume of the grinding wheel. Reduced shrinkage of wheels made by the method over comparable wheels made without the shrinkage control agent is obtained.

18 Claims, No Drawings

METHOD FOR MAKING VITREOUS BONDED ABRASIVE ARTICLE AND ARTICLE MADE BY THE METHOD

FIELD OF INVENTION

This invention pertains to vitreous bonded grinding wheels and to the method of making such wheels and other vitreous bonded abrasive products. The invention also relates to an improved method for producing vitreous bonded abrasive products, particularly grinding wheels, wherein a shrinkage reducing agent is employed to reduce or prevent shrinkage of the abrasive product during a firing operation in the method of making the product. Problems associated with shrinkage during the firing of vitreous bonded abrasive articles in prior art methods are minimized or eliminated by the invention.

BACKGROUND OF THE INVENTION

Vitreous bonded abrasive grinding wheels have been produced in the art for a long time by methods that essentially employ the steps of mixing together abrasive grains, vitreous or ceramic bond precursor ingredients (e.g. frit or oxides and silicates) and a temporary binder, placing the mixture in a mold and pressing the mixture in the mold to approximately the desired size and shape of the wheel, extracting volatiles from the pressed wheel, usually by heating the pressed wheel at a relatively low temperature (e.g. 200° to 300° C.), removing the wheel from the mold and then firing the wheel at a relatively high temperature (e.g. 500° to 1200° C.) in a furnace to form the vitreous bond and bind together the abrasive grains. The removing of volatiles from the pressed wheel before the firing step is generally done, in prior art methods, because such volatiles, introduced along with ingredients such as temporary binders, can cause bloating (non uniform expansion), rupture and distortion of the fired wheel if allowed to remain in the compressed wheel when the wheel is subjected to the high temperature firing step. The volatiles maybe water and/or organic materials. Heating the pressed wheel at a relatively low temperature has the further object of causing the temporary binder to bind together the various components of the wheel in a temporary and fragile manner so as to allow removal of the pressed wheel from the mold. This temporarily bound pressed wheel is often referred to as a green wheel. During the firing step, which generally takes place at temperatures far above the decomposition temperature of the temporary binder, the temporary binder is removed from the wheel and any residual volatile materials are expelled.

The firing of the pressed, temporarily bound (i.e. green) wheel usually is done at temperature in the range 500° to 1200° C. During this high temperature heating various physical and/or chemical transformations occur resulting in the formation of a vitreous or ceramic matrix that binds together the abrasive grains. It is during the firing step that pores are formed in the wheel and volume changes occur. The change in volume is often manifested in shrinkage of the wheel. Particulate materials for forming the vitreous bond matrix change chemically by reaction and/or physically by melting and/or fusing together. These chemical and/or physical changes produce a reduction in the volume occupied by the particulate material for forming the vitreous bond. Additional particulate material, other than the abrasive grain may be incorporated into the vitreous bond matrix and may act to cause a further reduction in volume. The extent of the shrinkage is in large measure dependent upon the magnitude of these changes and therefore on the amount, as well as the chemical and/or physical characteristics of, the vitreous bond forming matrix materials and other particulate materials used in making the wheel and upon the degree of porosity achieved in the wheel. Shrinkages of from 0.5% to 10% by volume are known, particularly in relatively porous wheels (e.g. 20% porosity by volume or greater). To exemplify and explain this matter of shrinkage one can visualize the particulate material for forming the vitreous bond matrix of the wheel as being glass beads. Placing these beads in a container to fill it even with the most efficient packing of the beads, leaves spaces unoccupied by the beads. The melting of the beads to form liquid glass results in a volume of glass less than the volume occupied by the beads. This change (i.e. reduction) in volume then is the shrinkage resulting from the melting of the glass beads.

Undersized wheels, out of tolerance central mounting holes for the relatively porous wheels, separation of mating segments (e.g. cores from rims) and even cracking or distortion of vitreous bonded grinding wheels have been some of the observed consequences of wheel shrinkage during firing. Some of these problems (e.g. undersized wheels) have been overcome in the art, by making the green wheel of a size sufficiently larger than the fired wheel to compensate for shrinkage or by making the fired wheel larger than the desired finished size and then machining the wheel to the proper size. Because shrinkage has been found in the art to be difficult to control in relatively porous wheels (i.e. to obtain consistent, reproducible results) the making of the green wheel of a size sufficient to compensate for shrinkage has not been found to be an all together reliable answer. A more acceptable answer to shrinkage has been the preparation of the vitreous bonded grinding wheel to a size larger than required and then machining the wheel to the correct size. However even here problems remain. The correction of out of tolerance mounting holes, even by machining, has been found to be a difficult problem. Machining vitreous bonded grinding wheels to size adds steps and cost to their manufacture. Some vitreous bonded grinding wheels, especially those produced with expensive abrasive grains such as diamond and cubic boron nitride, are made with a vitreous bonded abrasive rim encircling a vitreous bonded core containing inexpensive abrasive grain or no abrasive grain. In the known methods of making these wheels, shrinkage has been observed to cause separation of the core from the rim and even distortion of the wheel. Such problems result in scrap wheels (i.e. wheels unsuitable for use) and increased cost for these already expensive wheels.

SUMMARY OF INVENTION

It is an object of this invention to provide an improved method for making a vitreous bonded abrasive article, e.g. a grinding wheel.

It is another object of this invention to provide an improved method for making a vitreous bonded abrasive article that reduces or eliminates shrinkage.

A further object of this invention is to provide a vitreous bonded abrasive article free or substantially free of shrinkage effects.

The still further object of this invention is to overcome the prior art shrinkage problems in the manufacture of vitreous bonded abrasive articles.

These and other objects, as will become apparent from the following description and appended claims, are achieved in this invention in an improved method for making a vitreous bonded abrasive article having a porosity in the range of from 20% to 55% by volume (e.g. grinding wheel) comprising the steps of blending together the abrasive grain and other ingredients for making the article, pressing the blended ingredients in a mold to the shape and size of the article, and firing the article to form a vitreous matrix binding together the abrasive grain wherein the improvement comprises blending an unclad, non-abrasive, non-metallic, particulate, inorganic solid shrinkage control agent (SCA) (e.g. hexagonal boron nitride) into the ingredients for making the vitreous bonded abrasive article.

In the practice of the improved method of this invention vitreous bonded abrasive articles having porosity of 20 to 55% by volume, particularly vitreous bonded abrasive grinding wheels and more particularly rimmed grinding wheels having a porosity of 20 to 55% by volume, are obtained that are free or substantially free of prior art shrinkage induced defects and problems (e.g. undersized mounting holes, separation of rim from the core portion of a wheel and distortion of the wheel). Rimmed vitreous bonded grinding wheels may be wheels having a band of vitreous bonded abrasives, usually expensive abrasives such as diamond or cubic boron nitride, attached to a vitreous bonded core containing inexpensive abrasives (e.g. alumina, silicon carbide) or no abrasive grain therein.

DESCRIPTION OF THE INVENTION

The prior art manufacture of relatively porous (e.g. at least 20% porosity by volume) vitreous bonded grinding wheels employs the fundamental steps of a) mixing together abrasive grain, vitreous bond precursor and other ingredients to form a blend, b) placing the blend in a mold, c) compressing the blend in the mold to shape the blend and d) heating the shaped blend to form a vitreous matrix binding together the abrasive grain. These steps may be supplemented with other steps or various conditions including such individual steps as heating the compressed blend in the mold to remove volatile materials, removing the compressed blend from the mold prior to a firing step and firing or heating the compressed blend in the mold to form the vitreous matrix while maintaining a compressive force on the blend. The inclusion of this last step in the manufacturing process for vitreous bonded grinding wheels produces a method known as hot pressing and generally required special and expensive molds (e.g. graphite molds). This hot pressing method, usually used in the art for making small grinding wheels, is often performed in conjunction with an inert or reducing atmosphere. In the method of making vitreous bonded grinding wheels that does not employ the hot pressing technique the compressed blend is removed from the mold after a low temperature (200° to 300° C.) heating cycle to remove volatile materials and set the temporary binder. The shaped blend removed from the mold is then given a firing step to form the vitreous matrix binding together the abrasive grains. This latter method is generally referred to as a cold pressing method. Hot pressing in an inert or reducing atmosphere has been employed in the art where oxidation would be a problem in making the vitreous bonded grinding wheel or other abrasive product: Relatively speaking the cold pressing method is the prevalent method used in the art for making vitreous bonded grinding wheels.

In the prior art methods of making a relatively porous (e.g. at least 20% porosity by volume) vitreous bonded grinding wheel abrasive grains or a mixture of abrasive grains (e.g. aluminum oxide and silicon carbide) are blended with a vitreous bond precursor. This precursor may be a frit or a blend of raw materials (e.g. silicates, oxides, etc.) that forms the vitreous bond or matrix, during a firing step, to bind together the abrasive grains. The frit is generally a particulate glassy material that melts or fuses to form the vitreous bond or matrix of the grinding wheel or other abrasive article. The mixture of abrasive grains and vitreous bond precursor can be combined with an organic material that temporarily binds together the components of the wheel mix before the firing operation of the process. This temporary binder may be an organic polymeric material or polymer forming material. Phenolic resins have been found in the art to be useful temporary binders. Other materials such as lubricants, extreme pressure agents and fillers may be mixed with the abrasive grains, vitreous bond precursor and temporary binder. A measured amount of the blended components of the grinding wheel is then placed in a mold of the general size and shape of the desired grinding wheel. The uniformly distributed blend in the mold is then compacted, by the application of pressure, to a desired dimension and heated in the mold to a low temperature (e.g. 200° to 300° C.) to remove volatile materials present in the blend (e.g. water or organic solvents). Heating the compacted blend to a low temperature also causes the temporary binder to bind together the ingredients of the wheel into a relatively weak self supporting, shaped article capable of being handled prior to the firing operation of the process. The wheel is then removed from the mold and placed in a kiln or oven and heated to a high temperature (e.g. 500° to 1000° C.) over a prescribed time/temperature cycle to form the vitreous bond or matrix binding together the abrasive grains. Heating the mixture of abrasive grains, vitreous bond precursor, temporary binder and other materials to a high temperature for forming the vitreous bond causes chemical and/or physical changes to occur that result in the shrinkage of the wheel from its dimensions and volume prior to the high temperature heating (i.e. firing) step. Thus the wheel after firing would be smaller than before firing. Such shrinkage, therefore, has to be taken into consideration in prior art methods of making a finished wheel of specified dimensions. Shrinkage has been found to be not accurately or reliably reproducible in relatively porous grinding wheel and therefore prior art methods have generally taken this into account by making the fired vitreous bonded grinding wheel larger than the desired dimensions and then machining the fired wheel to the correct or final dimensions. Such machining or finishing is time consuming and adds cost to the production of the wheel. Thus the greater the machining or finishing required the more time and cost is added to making the grinding wheel. Generally grinding wheels have a central hole for mounting the wheel on a machine tool for carrying out a grinding operation. The correct size of this hole is important to the utilization of the grinding wheel. Shrinkage occurring in the manufacture of vitreous bonded grinding wheels effects the dimensions of the mounting hole, causing it to be smaller than desired. It then becomes necessary to machine the hole to the correct size. Such machining on vitreous bonded grinding wheel is by its nature difficult, time consuming and costly. Shrinkage during the art manufacture of vitreous bonded grinding wheels and other abrasive products is therefore an important problem. The reduction and desirably the elimination of shrinkage would therefore be a beneficial improvement in the art of making vitreous bonded grinding wheels and other abrasive products.

This invention attacks the problem of shrinkage in relatively porous vitreous bonded grinding wheels and provides an improved method for making vitreous bonded abrasive articles wherein shrinkage is reduced or eliminated. It has been discovered that the use of certain materials, referred to herein as shrinkage control agents (SCA), in the blend of ingredients or components for making a vitreous bonded abrasive article, having a porosity in the range of from 20 to 55% by volume, can reduce shrinkage of the article during the process. Thus in accordance with this invention there is provided an improved method for making a vitreous bonded abrasive article having a porosity in the range of from 20 to 55% by volume, more particularly a grinding wheel, comprising the steps of a) blending together abrasive grains and vitreous matrix precursor to form a uniform blend,
b) placing the blend in a mold,
c) compressing the blend to form a compressed shape, and
d) heating the compressed shape at a temperature for converting the vitreous matrix precursor to a vitreous matrix binding together the abrasive grains, the improvement comprising the step of mixing a shrinkage reducing effective amount of a shrinkage control agent with the abrasive grain and vitreous matrix precursor, said agent being an unclad, non-abrasive, non-metallic, particulate, inorganic solid.

In a preferred aspect of the invention disclosed and claimed herein the shrinkage control agent (SCA) is an unclad, non-abrasive, non-metallic, particulate, inorganic solid having a hardness in the range of from 1 to 4 on the Mohs scale selected from the group consisting of a) minerals containing oxygen and at least one of the elements of silicon, aluminum and magnesium and b) hexagonal boron nitride.

As used herein in the disclosure and claims of this invention the term unclad shall mean without a layer or coating of metal on the surface.

In one particular practice of this invention there is provided an improved method for making a vitreous bonded abrasive grinding wheel having a porosity in the range of from 20 to 55% by volume comprising the steps of a) blending together abrasive grains, vitreous matrix precursor and a temporary binder material to form a uniform blend,
b) placing the blend in a mold,
c) compressing the blend while in the mold,
d) heating the compressed blend, while in the mold, at a temperature below the temperature for converting the vitreous matrix precursor to a vitreous matrix binding together the abrasive grains, to form a self supporting shaped molding,
e) removing the molding from the mold, and
f) heating the molding at a temperature sufficient to convert the vitreous matrix precursor to a vitreous matrix binding together the abrasive grains, wherein the improvement comprises the step of mixing a shrinkage reducing effective amount of non-abrasive hexagonal boron nitride with the abrasive grains, vitreous matrix precursor and temporary binder material.

Another particular practice of this invention provides an improved method for making a vitreous bonded abrasive grinding wheel having a porosity in the range of from 20 to 55% by volume comprising the steps of a) blending together cubic boron nitride abrasive grains, vitreous matrix precursor and temporary binder material to form a uniform blend,
b) placing the blend in a mold,
c) compressing the blend while in the mold,
d) heating the compressed blend, while in the mold, at a temperature below the temperature for converting the vitreous matrix precursor to a vitreous matrix binding together the abrasive grains, to form a self supporting, shaped molding,
e) removing the molding from the mold, and
f) heating the molding at a temperature sufficient to convert the vitreous matrix precursor to a vitreous matrix binding together the abrasive grains, wherein the improvement comprises the step of mixing a shrinkage reducing effective amount of non-abrasive hexagonal boron nitride with the cubic boron nitride abrasive grains, vitreous matrix precursor and temporary binder material.

In a still further practice of this invention there is provided an improved method for making a vitreous bonded abrasive grinding wheel having a porosity in the range of from 20 to 55% by volume comprising the steps of a) blending together cubic boron nitride abrasive grains, fused alumina abrasive grains, vitreous matrix precursor and temporary binder material into a uniform blend,
b) placing the blend in a mold,
c) compressing the blend while in the mold,
d) removing the molding from the mold and, heating the molding at a temperature sufficient to convert the vitreous matrix precursor to a vitreous matrix binding together the abrasive grains, wherein the improvement comprises the step of mixing a shrinkage reducing effective amount of non-abrasive hexagonal boron nitride with the cubic boron nitride abrasive grains, fused alumina abrasive grains and temporary binder material.

Other practices of this invention may employ the above described procedures and pyrophyllite, talc or mica as the SCA instead of the hexagonal boron nitride SCA.

Various abrasive grains and mixtures of abrasive grains may be employed in the practice of this invention, including but not limited to fused alumina, sintered sol-gel alumina, sol-gel aluminum nitride/aluminum oxynitride, silicon carbide, cubic boron nitride and diamond abrasive grits or grains. These and other abrasive grains may be of conventional sized well known in the art. Abrasive grains of 60 to 325 mesh, U.S. Standard Sieve Sizes, preferably in the range of from 100 to 200 mesh, are usable in the practice of this invention. Various combinations of abrasive grains different in composition and/or size may be used. Mixtures of abrasive grains of the same composition but different sizes and of abrasive grains of different compositions with the same or different sizes can be employed in the method and article of this invention.

The vitreous matrix precursor employed in this invention is the material or mixture of materials which, when heated in the firing step, forms the vitreous matrix that binds together the abrasive grains of the abrasive article. This vitreous matrix, binding together the abrasive grains, is also known in the art as the vitreous phase, vitreous bond, ceramic bond or glass bond of the abrasive article. The vitreous matrix precursor may be more particularly a combination or mixture of oxides and silicates that upon being heated to a high temperature react to form a glass or ceramic matrix or may be a frit, which when heated to a high temperature in the firing step melts and/or fuses to form the vitreous matrix of the abrasive article. Various combinations of materials well known in the art may be used as the vitreous matrix precursor. Primarily such materials are metallic oxides and silicates. Preformed fine particle glasses (i.e. frits) made from various combinations of oxides and silicates may be used as the vitreous matrix precursor. Such frits are commonly known and commercially available. These frits are generally made by first preparing a combination of oxides and silicates that is heated to a high temperature to form a glass. The glass, after being cooled, is then broken into small particles. Temperatures in the range of from 1000° F. to 2500° F. may be employed in the practice of this invention for converting the vitreous matrix precursor to the vitreous matrix binding together the abrasive grains of the abrasive article. Such heating is commonly referred to as a firing step and usually carried out in a kiln or furnace where the temperature and times that are employed in heating the abrasive article are controlled or variably controlled in accordance with such factors as the size and shape of the abrasive article, the abrasive grain and the composition of the vitreous matrix precursor. Firing conditions for making vitreous bonded abrasive articles are well known in the art and such conditions may be employed in the practice of this invention.

It is known in the art to use various additives in the making of vitreous bonded abrasive articles, both to assist in and improve the ease of making the article and the performance of the article. Such additives may include lubricants, fillers, temporary binders and processing aids. These additives, in amounts well known in the art, may be used in the practice of this invention for their intended purpose.

Shrinkage of relatively porous (e.g. 20% porosity by volume or greater) vitreous bonded abrasive articles during their manufacture is well-known in the prior art. A given amount of a mixture of abrasive grain, vitreous matrix precursor and optional other ingredients when placed in a mold and pressed yields a pressed shape of defined dimensions and volume. This shape, when heated in a firing step to form the vitreous matrix binding together the abrasive grain, shrinks in volume and the resulting vitreous bonded abrasive article is of a volume less than that of the pressed shape prior to the firing step. To compensate for this shrinkage (i.e. reduction in volume) it is known to have the pressed shape, prior to firing, of a size sufficiently larger than the size of the fired abrasive article to correct for the shrinkage during firing. Such compensation may furnish a fired vitreous bonded abrasive article (e.g. grinding wheel) substantially of the desired size and shape. It is also known in the art to employ a pressed shape having a size not only sufficient to compensate for shrinkage during firing but also to produce a fired vitreous bonded abrasive article having a size larger than the desired size and to machine the article to the desired dimensions. The production of a pressed shape having a size just large enough to compensate for expected shrinkage does not consistently produce fired grinding wheels of the desired dimensions because shrinkage is hard to control and reproduce to a satisfactory degree. Thus this method of dealing with shrinkage is not entirely satisfactory. Making the grinding wheel larger than desired and then machining it to the proper dimensions adds steps, time and cost to the manufacture of the wheel. This invention seeks to overcome these difficulties in the prior art processes for making a vitreous bonded abrasive article. To surmount these difficulties and disadvantages there is provided in accordance with the method of this invention the step of mixing a shrinkage reducing effective amount of an SCA with the abrasive grain and vitreous matrix precursor, said shrinkage control agent being an unclad, non-abrasive, non-metallic, particulate, inorganic solid. The SCA may have a particle size over a wide range. The particle size may be smaller, or even larger, than the abrasive grains. Shrinkage control agents having a particle size in the range of from 60 to 325, preferably 100 to 200, mesh, U.S. Standard Sieve Size, may be used in the practice of this invention. Since shrinkage of vitreous bonded abrasive articles may vary over a wide range with the amounts and chemical and physical characteristics of the ingredients and conditions for making the article, the shrinkage reducing effective amount of SCA employed in the practice of this invention may vary over a wide range. Amounts of SCA of from 0.5 to 20% by volume, preferably 1 to 10% and more preferably 4 to 8% by volume, based on the volume of the vitreous bonded abrasive article may be employed in the practice of this invention. Preferably, the SCA is an unclad, non-abrasive, non-metallic, particulate, inorganic solid having a hardness in the range of from 1 to 4 on the Mohs scale selected from the group consisting of a) minerals containing oxygen and at least one of the elements of silicon, aluminum and magnesium, and b) hexagonal boron nitride. Minerals containing oxygen and at least one of the elements of silicon, aluminum and magnesium and having a hardness in the range of from 1 to 4 on the Mohs scale for example include, but are not limited to, pyrophyllite, talc, mica, allophane, brucite and chlorite. Various other elements (e.g. iron, lithium, potassium, and sodium) may occur in addition to at least one of the elements of silicon, aluminum and magnesium in the minerals usable as shrinkage control agents in the practice of this invention. In addition to the presence of oxygen pyrophyllite contains aluminum and silicon, talc contains silicon and magnesium, allophane contains aluminum and silicon, brucite contains magnesium, chlorite contains silicon, aluminum and magnesium and mica contains silicon and aluminum along with one or more of magnesium, iron, lithium, sodium or potassium.

In the manufacture of vitreous bonded abrasive grinding wheels it is known to vary the steps and conditions for such manufacture in accordance with both the materials employed in making the wheel and the size and shape of the wheel. The steps and conditions for the practice of the method of this invention may be varied to meet the various materials used for making the vitreous bonded abrasive article as well as the shape and size of the article. Thus, for example, in one practice of the method of this invention abrasive grain may be mixed with the vitreous matrix precursor, a temporary binder material then blended into the mixture of abrasive grain and vitreous matrix precursor, additives then added and blended in and the SCA then added and blended into the previously mixed ingredients. The resulting blend may then be placed in a mold and compressed to substantially the desired size and shape. This compressed blend may be heated in the mold to a temperature sufficient to remove any volatile materials in the blend and for the temporary binder to bind the ingredients together in a temporary self supporting shape, but below a temperature for converting the vitreous matrix precursor to the vitreous matrix binding together the abrasive grains. The self supporting shape may then be removed from the mold and heated to a temperature for converting the vitreous matrix precursor to a vitreous matrix binding together the abrasive grains. In another example of the practice of this invention the above procedure may be substantially followed except that the order in which the ingredients (i.e. abrasive grain, vitreous matrix precursor, SCA etc.) are blended together. The abrasive grains may be blended with a temporary binder material to uniformly coat the grains with binder, vitreous matrix precursor then mixed with the coated grains, other ingredients individually added and blended into the previously mixed materials and then the SCA added and mixed into the combination. Another example of the practice of the method of this invention could include the blending together of SCA and abrasive grains, the addition thereto and blending in of the vitreous matrix precursor and then the addition and blending in of the temporary binder followed individually by the other ingredients for making the article. This blending procedure would be followed by the remaining steps (e.g. addition of the mixture to the mold, compressing the mixture, and firing the compressed mixture) of the manufacturing process. Thus, the particular point in the method of this invention at which the step occurs of mixing the shrinkage control agent with the abrasive grain, vitreous bond precursor and other ingredients for making the vitreous bonded abrasive article may be varied.

Conventional blending and mixing techniques, conditions and equipment, well known in the art, may be employed in the practice of this invention. Techniques, conditions and equipment well known in the art for pressing vitreous bonded abrasive articles, e.g. grinding wheels, prior to firing the article may be used. Drying of the pressed vitreous bonded abrasive article prior to firing the article may be used to remove water or organic solvents, usually introduced into the article with the temporary binder, may be carried out using techniques, conditions and equipment well known in the art. After drying the pressed abrasive article, usually termed the green article or wheel, is heated to high temperatures, e.g. 1000° F. to 2500° F., to form the vitreous matrix binding together the abrasive grains.

A vitreous bonded abrasive article, e.g. grinding wheel, is generally known to have pores (i.e. free space). The amount of pores in the article can usually be controllably varied depending upon such factors as the size and composition of the abrasive grain, the composition of the vitreous bond, the presence, composition and amount of pore inducing material and the conditions under which the article is fired. A wide range of porosity in vitreous bonded abrasive articles is known in the art. Such porosity is generally expressed as a percentage of the total or geometric volume of the article. Thus, for example, a vitreous bonded abrasive grinding wheel may have a porosity of 40% of the geometric volume meaning that 40% of the geometric volume of the fired wheel is pores or free space. The % porosity by volume of a fired vitreous bonded abrasive article may be calculated from the known geometric volume of the article and the volume % of each of the components retained in the article after the firing step in its manufacture. Given the amount by weight of each of the components used in the article and the true density of each component there can be calculated the volume of each component in the article. A total of the volume of the components retained in the article after firing can then be subtracted from the geometric volume of the article and the resultant value then divided by the geometric volume of the article. The value so obtained multiplied by 100 gives the percent porosity of the article. In a similar manner the percent by volume of each of the components retained in the fired article may be added together and the sum subtracted from 100 to give the percent porosity by volume. This latter procedure can be applied in the examples below by adding the percent by volume of the abrasive, bond and shrinkage control agent in each example and subtracting that sum from 100.

This invention will now be further described in the following non-limiting examples wherein, unless otherwise specified, the amounts of materials are by weight, temperature is in degrees Fahrenheit, mesh in U.S. Standard Sieve sizes and 1) 2A Alumina is fused alumina abrasive
2) MEM alumina is CUBITRON MEM Sol-Gel Alumina Abrasive in accordance with the disclosure and claims of U.S. Pat. No. 4,881,951 issued Nov. 21, 1989 and obtained from the Minnesota Mining and Manufacturing Company (CUBITRON is a registered trademark of the Minnesota Mining and Manufacturing Company).
3) 3029 resin is a temporary binder material having 65% by weight solid urea formaldehyde resin and 35% by weight water.
4) Bond A is an equal parts by weight mixture of two frits. Frit number one has an oxide based composition by weight of $SiO_2$ 43.5%, $TiO_2$ 1.18%, $Al_2O_3$ 14.26%, $B_2O_3$ 28.63%, CaO 2.14% and MgO 10.29% Frit number 2 has an oxide based composition by weight of $SiO_2$ 59.0%, $Al_2O_3$ 3.0%, $B_2O_3$ 25.0%, MgO 4.0%, $Li_2O$ 1.0%, $K_2O$ 2.0%, $Na_2O$ 2.0% and ZnO 4.0%.
5) Agrashell is commercially available crushed walnut shells obtained from Agrashell Inc.

Examples 1 to 34 below pertain to vitreous bonded abrasive bars having the nominal dimensions of 0.250×0.254×1.56 inches (a volume of 0.099 cubic inches) and were made for determining shrinkage behavior. The bars were prepared in the following manner using the materials and amounts (i.e. % by weight) shown in the examples. The abrasive grain or mixture of abrasive grains was thoroughly blended with the shrinkage control agent (i.e. hexagonal boron nitride, pyrophyllite, talc or mica). To the resulting mixture there was added, with mixing, the 3029 resin and the combination blended together. The bond and dextrin were uniformly mixed together and the resulting blend added, with mixing, to the combination of abrasive grain, shrinkage control agent and 3029 resin. The resulting uniform blend or formulation was then measured into a mold cavity having the nominal dimensions of 0.254 by 1.56 inches and variable depth, and pressed to a nominal thickness of 0.25 inches. The pressed bar, having nominal dimensions of 0.25×0.254×1.56 inches, was removed from the mold and air dried for at least one hour at room temperature. After measuring and treating the bar in accordance with the procedure for determining shrinkage it was fired in a furnace by heating it to 1525° F. at a rate of 100° F. per hour and holding it at 1525° F. for 6 hours. The bar was then allowed to cool to room temperature in the furnace with the furnace turned off.

The grinding wheels of Examples 35 to 37 below were prepared in the same manner as the bars of Examples 1 to 34 as respects the mixing of the ingredients and firing of the pressed wheel. The mold used for making the wheels of Examples 35 to 37 had a cavity to produce a wheel having a nominal outside diameter of 0.75 inches, a nominal thickness of 0.50 inches and a nominal inside diameter of 0.50 inches. Thoroughly mixed ingredients of Examples 35 to 37 were measured into the wheel mold, pressed to the desired nominal dimensions and the pressed wheel removed from the mold. After air drying the pressed wheel for at least one hour, it was fired in accordance with the conditions and schedule described in the procedure for making the bars of Examples 1 to 34.

The percent volume shrinkage given in the following examples was determined in accordance with a well known standard procedure and calculations described in Chapter IV, pages 27 to 42 of Ceramic Tests and Calculations by A. I. Andrews, published by John Wiley & Sons Inc., copyrighted 1948. In some of the examples below it is to be noted that expansion, rather than shrinkage, occurred. The % volume expansion was determined in a like manner to the % volume shrinkage with the appropriate necessary operational sign changes in the calculations.

Examples 1 to 3

| Example No. | 1 | 2 | 3 |
|---|---|---|---|
| 2A Alumina 80 grit | 63.75 | 62.78 | 61.69 |
| 3029 Resin | 6.69 | 6.58 | 6.70 |
| Bond A | 27.78 | 27.36 | 26.89 |
| Dextrin | 1.79 | 1.76 | 1.73 |
| Hexagonal boron nitride (HBN) | | 1.52 | 2.99 |
| HBN particle size (mesh) | | 100/120 | 100/120 |
| Volume % abrasive in fired article | 41.0 | 41.0 | 41.0 |
| Volume % bond in fired article | 31.0 | 31.0 | 31.0 |
| Volume % hexagonal boron nitride | 0 | 2 | 4 |
| % Volume shrinkage | 1.668 | 1.28 | 1.087 |

Examples 4 to 8

| Example No. | 4 | 5 | 6 | 7 | 8 |
|---|---|---|---|---|---|
| 2A Alumina 80 grit | 69.37 | 68.23 | 66.95 | 65.88 | 64.71 |
| 3029 Resin | 6.25 | 6.15 | 6.29 | 6.19 | 6.30 |
| Bond A | 22.43 | 22.06 | 21.65 | 21.30 | 20.93 |
| Dextrin | 1.94 | 1.91 | 1.88 | 1.85 | 1.81 |
| HBN 100/120 mesh | | 1.65 | 3.24 | 4.79 | 6.25 |
| Volume % abrasive (fired art.) | 41.0 | 41.0 | 41.0 | 41.0 | 41.0 |
| Volume % bond (fired art.) | 23.0 | 23.0 | 23.0 | 23.0 | 23.0 |
| Volume % HBN | 0 | 2 | 4 | 6 | 8 |
| % Volume shrinkage | 0.833 | 0.770 | 0.640 | 0.255* | 0.891* |

Examples 9 to 11

| Example No. | 9 | 10 | 11 |
|---|---|---|---|
| 2A Alumina 80 grit | 69.37 | 65.88 | 65.88 |
| 3029 Resin | 6.25 | 6.19 | 6.19 |
| Bond A | 22.43 | 21.30 | 21.30 |
| Dextrin | 1.94 | 1.85 | 1.85 |
| Hexagonal boron nitride (HBN) | | 4.79 | 4.79 |
| HBN particle size (mesh) | | 70/80 | 240/270 |
| Volume % abrasive in fired article | 41.0 | 41.0 | 41.0 |

-continued

| | | | |
|---|---|---|---|
| Volume % bond in fired article | 23.0 | 23.0 | 23.0 |
| Volume % HBN | 0 | 6 | 6 |
| % Volume shrinkage | 0.833 | 0.126 | 0.448 |

Examples 12 and 13

| Example No. | 12 | 13 |
|---|---|---|
| 2A Alumina 280 grit | 63.29 | 62.33 |
| 3029 Resin | 7.36 | 7.25 |
| Bond A | 27.58 | 27.17 |
| Dextrin | 1.77 | 1.75 |
| HBN 100/120 mesh | | 1.51 |
| Volume % abrasive in fired article | 41.0 | 41.0 |
| Volume % bond in fired article | 31.0 | 31.0 |
| Volume % hexagonal boron nitride | 0 | 2 |
| % Volume shrinkage | 0.574 | 0.255 |

Examples 14 and 15

| Example No. | 14 | 15 |
|---|---|---|
| 2A Alumina 100 grit | 58.94 | 58.52 |
| 3029 Resin | 7.07 | 7.02 |
| Bond A | 32.34 | 32.11 |
| Dextrin | 1.65 | 1.64 |
| Hexagonal boron nitride (HBN) | | 0.71 |
| HBN particle size (mesh) | | 100/120 |
| Volume % abrasive in fired article | 41.0 | 41.0 |
| Volume % bond in fired article | 39.0 | 39.0 |
| Volume % hexagonal boron nitride | 0 | 1 |
| % Volume shrinkage | 1.923 | 1.923* |

Examples 16 and 17

| Example No. | 16 | 17 |
|---|---|---|
| 2A Alumina 100 grit | 72.87 | 69.33 |
| 3029 Resin | 6.72 | 7.32 |
| Bond A | 18.01 | 17.13 |
| Dextrin | 2.39 | 2.28 |
| HBN 100/120 mesh | | 3.94 |
| Volume % abrasive in fired article | 35.0 | 35.0 |
| Volume % bond in fired article | 15.0 | 15.0 |
| Volume % hexagonal boron nitride | 0 | 4 |
| % Volume shrinkage | 3.896 | 2.391 |

Examples 18 and 19

| Example No. | 18 | 19 |
|---|---|---|
| 2A Alumina 80 grit | 65.65 | 62.73 |
| 3029 Resin | 7.07 | 7.05 |
| Bond A | 21.23 | 20.29 |
| Dextrin | 1.84 | 1.76 |
| Pyrophyllite 100/120 mesh | 4.28 | 8.17 |
| Volume % abrasive in fired article | 41.0 | 41.0 |
| Volume % bond in fired article | 23.0 | 23.0 |
| Volume % pyrophyllite | 4 | 8 |
| % Volume shrinkage | 0 | 0.826* |

Examples 20 to 22

| Example No. | 20 | 21 | 22 |
|---|---|---|---|
| 2A Alumina 80 grit | 63.75 | 62.79 | 61.25 |
| 3029 Resin | 6.69 | 7.06 | 7.35 |
| Bond A | 27.78 | 27.37 | 26.69 |
| Dextrin | 1.79 | 1.76 | 1.72 |
| Pyrophyllite 100/120 mesh | | 1.02 | 2.99 |
| Volume % abrasive in fired article | 41.0 | 41.0 | 41.0 |
| Volume % bond in fired article | 31.0 | 31.0 | 31.0 |
| Volume % pyrophyllite | 0 | 1 | 3 |
| % Volume shrinkage | 1.668 | 1.153 | 0.767 |

Examples 23 and 24

| Example No. | 23 | 24 |
|---|---|---|
| 2A Alumina 80 grit | 62.72 | 61.06 |
| 3029 Resin | 7.05 | 7.33 |
| Bond A | 27.33 | 26.61 |
| Dextrin | 1.76 | 1.71 |
| Mica 100/120 mesh | 1.14 | 3.28 |
| Volume % abrasive in fired article | 41.0 | 41.0 |
| Volume % bond in fired article | 31.0 | 31.0 |
| Volume % mica | 1 | 3 |
| % Volume shrinkage | 0.996 | 0.777 |

-continued

Examples 25 and 26

| Example No. | 25 | 26 |
|---|---|---|
| 2A Alumina 80 grit | 62.78 | 61.21 |
| 3029 Resin | 7.06 | 7.35 |
| Bond A | 27.36 | 26.67 |
| Dextrin | 1.76 | 1.71 |
| Talc 200 mesh | 1.05 | 3.06 |
| Volume % abrasive in fired article | 41.0 | 41.0 |
| Volume % bond in fired article | 31.0 | 31.0 |
| Volume % talc | 1 | 3 |
| % Volume shrinkage | 1.153 | 0.767 |

Examples 27 and 28

| Example No. | 27 | 28 |
|---|---|---|
| 2A Alumina 100 grit | 5.79 | 5.60 |
| Cubic boron nitride 80/100 grit | 54.22 | 52.46 |
| 3029 Resin | 8.63 | 8.35 |
| Bond A | 29.47 | 28.51 |
| Dextrin | 1.89 | 1.83 |
| Hexagonal boron nitride 100/120 mesh | | 3.24 |
| Volume % abrasive in fired article | 41.0 | 41.0 |
| Volume % bond in fired article | 31.0 | 31.0 |
| Volume % hexagonal; boron nitride | 0 | 4 |
| % Volume shrinkage | 6.963 | 6.091* |

Examples 29 and 30

| Example No. | 29 | 30 |
|---|---|---|
| 2A Alumina 280 grit | 28.26 | 27.28 |
| Cubic boron nitride 230/270 grit | 38.71 | 37.36 |
| 3029 Resin | 7.59 | 7.33 |
| Bond A | 23.41 | 22.60 |
| Dextrin | 2.03 | 1.96 |
| Hexagonal boron nitride 100/120 mesh | | 3.47 |
| Volume % abrasive in fired article | 41.0 | 41.0 |
| Volume % bond in fired article | 23.0 | 23.0 |
| Volume % hexagonal; boron nitride | 0 | 4 |
| % Volume shrinkage | 2.319 | 1.247 |

Examples 31 and 32

| Example No. | 31 | 32 |
|---|---|---|
| Silicon carbide 100 grit | 5.19 | 5.01 |
| Cubic boron nitride 80/100 grit | 60.43 | 58.25 |
| 3029 Resin | 7.90 | 7.62 |
| Bond A | 24.37 | 23.49 |
| Dextrin | 2.11 | 2.04 |
| Hexagonal boron nitride 100/120 mesh | | 3.60 |
| Volume % abrasive in fired article | 41.0 | 41.0 |
| Volume % bond in fired article | 23.0 | 23.0 |
| Volume % hexagonal boron nitride | 0 | 4 |
| % Volume shrinkage | 4.484 | 0.288 |

Examples 33 and 34

| Example No. | 33 | 34 |
|---|---|---|
| MEM Alumina 80 grit | 63.33 | 62.36 |
| 3029 Resin | 6.76 | 6.66 |
| Bond A | 28.10 | 27.67 |
| Dextrin | 1.81 | 1.78 |
| Hexagonal boron nitride 100/120 mesh | | 1.54 |
| Volume % abrasive in fired article | 41.0 | 41.0 |
| Volume % bond in fired article | 31.0 | 31.0 |
| Volume % hexagonal boron nitride | 0 | 2 |
| % Volume shrinkage | 1.926 | 1.283 |

Examples 35 to 37

| Example No. | 35 | 36 | 37 |
|---|---|---|---|
| Cubic boron nitride 60 grit | 59.11 | 57.78 | 57.19 |
| 3029 Resin | 9.60 | 9.39 | 9.29 |
| Bond A | 29.39 | 28.73 | 28.44 |
| Dextrin | 1.90 | 1.86 | 1.84 |
| Shrinkage control agent | none | AS* | HBN** |
| % Volume shrinkage | 2.821 | 3.040 | 0.704 |

Examples 38 and 39

| Example No. | 38 | 39 |
|---|---|---|
| Cubic boron nitride 100/120 grit | 36.10 | 34.93 |
| 2A Alumina 100 grit | 26.36 | 25.51 |
| 3029 Resin | 8.10 | 7.84 |
| Bond A | 27.55 | 26.66 |
| Dextrin | 1.90 | 1.84 |
| Hexagonal boron nitride 100/120 mesh | 0 | 3.23 |
| % Volume shrinkage | 4.566 | 0.461 |
| G - Ratio | 250.82 | 453.28 |

*% Volume expansion
*AS is Agrashell 100/120 mesh
**HBN is hexagonal boron nitride 100/120 mesh
Grinding wheel size 0.75 inch OD × 0.50 inch Thickness × 0.50 inch ID
Wheel size 0.75 × 0.625 × 0.375 inches The grinding wheels of Examples 38 and 39 were prepared in the same manner and using the same conditions described for the preparation of the bars of Examples 1 to 34 and wheels of Examples 35 to 37, except as respects the size of the mold employed for the wheels of Examples 38 and 39. The G-ratio (i.e. ratio of volume of metal removed per unit volume of wheel wear) values were measured in a grinding test conducted in the following manner.

In the grinding tests the wheels were mounted on a IEF Cinternal grinder and a reciprocating grind performed on the internal diameter of a 3 inch×1.045 inch×0.375 inch 52100 steel cylindrical workpiece, hardened to 60 to 62 Rockwell C, at a wheel speed of 41,009 RPM, an infeed rate of 0.060 inches per minute and a workpiece rotation speed of 150 surface feet per minute. Each test was conducted to remove 0.75 cubic inches of metal. CIMPERIAL HD-90 aqueous based metalworking fluid was used during each test. CIMPERIAL is a registered trademark of Cincinnati Milacron Inc. Measurements were made of wheel wear and metal removed for each test to compute G-ratio values.

What is claimed is:

1. An improved method for making a vitreous bonded abrasive article having a porosity in the range of from 20 to 55% by volume comprising the steps of a) blending together abrasive grains and vitreous matrix precursor to form a uniform mixture, b) placing the mixture in a mold, c) compressing the mixture while in the mold and to form a compressed shape, d) heating the compressed shape at a temperature for converting the vitreous matrix precursor to a vitreous matrix binding together the abrasive grains, the improvement comprising the step of mixing a shrinkage reducing effective amount of a shrinkage control agent selected from the group consisting of minerals containing oxygen and a least one of the elements of silicon, aluminum and magnesium and hexagonal boron nitride having a hardness in the range of from 1 to 4 on the Mohs scale with the abrasive grains and vitreous matrix precursor, said agent being an unclad, non-abrasive, non metallic, particulate inorganic solid.

2. The method according to claim 1 wherein the shrinkage control agent is a mineral containing oxygen and at least one of the elements of silicon, aluminum and magnesium.

3. The method of claim 1 wherein the shrinkage control agent is non-abrasive hexagonal boron nitride.

4. The method of claim 1 wherein a temporary binder is included in step (a) and there are provided the further steps of heating the compressed shape, while in the mold, to a temperature below the temperature for converting the vitreous matrix precursor into a vitreous matrix binding together the abrasive grains, to form a self supporting shaped molding and thereafter removing said molding from the mold prior to step (d).

5. The method of claim 1 wherein the abrasive grain is cubic boron nitride.

6. A method as in claim 1 in which the abrasive grain is a mixture of cubic boron nitride abrasive grain and fused alumina abrasive grain.

7. A method as in claim 1 wherein there is included a step of mixing together abrasive grain and shrinkage control agent before a step of mixing abrasive grain with other ingredients for producing the vitreous bonded abrasive article.

8. A method as in claim 1 in which the shrinkage control agent is used in amount ranging from 1 to 10% by volume based on the volume of the article.

9. The method of claim 2 wherein the vitreous matrix precursor is a frit.

10. The method of claim 3 wherein the abrasive grain is cubic boron nitride.

11. A method as in claim 3 wherein the vitreous matrix precursor is a frit.

12. The method of claim 7 in which the shrinkage control agent is non-abrasive hexagonal boron nitride.

13. The method of claim 8 wherein the amount of shrinkage control agent is in the amount ranging from 4 to 8% by volume based on the volume of the article.

14. The method of claim 10 in which the hexagonal boron nitride is used in an amount ranging from 1 to 10% by volume based on the volume of the article.

15. A vitreous bonded abrasive article having a porosity in the range of from 20 to 55% by volume produced by an improved method comprising the steps of a) blending together abrasive grains and vitreous matrix precursor to form a uniform mixture, b) placing the mixture in a mold, c) compressing the mixture while in the mold to form a compressed shape and d) heating the compressed shape at a temperature for converting the vitreous matrix precursor to a vitreous matrix binding together the abrasive grains, the improvement comprising the step of mixing a shrinkage reducing effective amount of a shrinkage control agent selected from the group consisting of minerals containing oxygen and a least one of the elements of silicon, aluminum and magnesium and hexagonal boron nitride having a hardness in the range of from 1 to 4 on the Mohs scale with the abrasive grains and vitreous matrix precursor, said agent being an unclad, non-abrasive, non-metallic, particulate, inorganic solid.

16. The vitreous bonded abrasive article according to claim 14 wherein the shrinkage control agent is a mineral containing oxygen and at least on of the elements of silicon, aluminum and magnesium.

17. The vitreous bonded abrasive article according to claim 14 wherein the shrinkage control agent is hexagonal boron nitride.

18. A vitreous bonded abrasive article according to claim 14 wherein the abrasive is cubic boron nitride.

* * * * *